United States Patent [19]

Sivachenko

[11] 4,442,650

[45] Apr. 17, 1984

[54] GIRDER CONSTRUCTION

[76] Inventor: Eugene W. Sivachenko, 6471 Riverside Dr., Redding, Calif. 96001

[21] Appl. No.: 860,798

[22] Filed: Dec. 15, 1977

[51] Int. Cl.[3] ..... E04C 3/02

[52] U.S. Cl. ..... 52/694; 52/797

[58] Field of Search ..... 52/693, 694, 696, 636, 52/618, 695, 639, 648, 643

[56] References Cited

U.S. PATENT DOCUMENTS

| | | | |
|---|---|---|---|
| 1,604,150 | 10/1926 | Dornier | 52/694 |
| 1,865,059 | 6/1932 | Ragsdale | 52/694 X |
| 1,949,818 | 3/1934 | Tarbox | 52/694 |
| 2,136,071 | 11/1938 | Braden | 52/694 |
| 2,746,580 | 5/1956 | Benz | 52/694 |
| 3,247,629 | 4/1966 | Behlen | 52/694 X |
| 4,030,256 | 6/1977 | Ollman | 52/634 X |

FOREIGN PATENT DOCUMENTS

| | | | |
|---|---|---|---|
| 273196 | 3/1930 | Italy | 52/694 |

*Primary Examiner*—Carl D. Friedman

*Attorney, Agent, or Firm*—Townsend and Townsend

[57] ABSTRACT

A girder defined by spaced apart, parallel upper and lower longitudinally corrugated chord plates and an intermediate, sinusoidal connecting member defining serially arranged, diagonally disposed webs and web connecting upper and lower crown sections in contact with the chord plates. Means is provided to assure metal-to-metal contact between the connecting member and the chord plates. The crown sections of the former are secured to the chord plates at their common contact points. The connecting member has corrugations complementary to those of the chord plates.

4 Claims, 11 Drawing Figures

GIRDER CONSTRUCTION

BACKGROUND OF THE INVENTION

The present invention relates to structural members such as girders which rest on spaced apart supports and which are capable of supporting relatively large payloads.

Girders as such are well-known in the art and widely used for spanning the distance between spaced apart supports such as upright building walls while carrying a load, e.g. a flat building roof and roof loads such as snow or water. The actual construction of such girders varies widely depending on their span, the payload and the cost of materials. Generally, however, the greater span and/or the payload the more intricate is the construction of the girders. Thus, high strength girders for very large loads and/or spans invariably are fabricated from a variety of I-beams, channels, angles, plate and the like. Such girders are relatively heavy and, in view of today's high material costs, are expensive for this reason alone. In addition, they require a great amount of labor to assemble them which further increases their cost. Nevertheless, such girders have found widespread use and they continue to be used inspite of their cost because for many applications no feasible alternatives exist.

For light forms of constructions in which the payload and/or girder length is relatively small substantially simplified girders can be used. U.S. Pat. Nos. 1,604,150; 2,746,580 or 3,122,224 are exemplary of such structures. For example, the first mentioned patent proposes a girder for light forms of construction such as for carrying trellis which is made of a pair of parallel, spaced apart flanges which are interconnected by a web member that extends between the flanges in a zigzag fashion. The flanges and the web are provided with longitudinally extending, intermittent, relatively narrow channels to achieve a nesting of all components of the girder and to rigidify it.

Although the girder disclosed in that patent, as well as in the others eliminates a substantial portion of the cost which results from fabricating girders of multiple welded, bolted, riveted or the like components, they have not replaced fabricated girders for high strength applications. The exact reasons for this are unclear, but it is apparent that they include the fact that the profiles suggested in the patents are incapable of carrying substantial loads over the desired spans. In addition, it is likely that the connections between the flanges and the intermediate web members could not be made sufficiently strong to carry the loads because of the relatively small contact points between them which are unable to safely transmit large loads.

SUMMARY OF THE INVENTION

The present invention provides a relatively lightweight girder adapted for high strength applications which does not exhibit the earlier discussed shortcomings of prior art high strength girders. Generally speaking, a girder constructed in accordance with the present invention includes an upper chord plate constructed of corrugated plate having alternating corrugation peaks and corrugation troughs of substantially like dimensions and a spaced apart, substantially parallel lower chord plate. A sinusoidally undulated connection member is disposed between the chord plates and defines a plurality of serially arranged diagonal webs. The connection member includes at least one corrugation having a size and shape complementary to the corrugations of the upper chord plate. Means is further provided for rigidly securing the connecting member to the chord plates at points at which they are in mutual engagement and in a manner which permits the transmission of large forces between them.

Although, the lower chord plate may be a flat plate, it preferably has the same corrugations as the upper chord plate and all components of the girder, that is both chord plates and the connection members have substantially like widths. The corrugations themselves have a trapezoidal cross-section, a corrugation pitch of at least about 16 inches and a corrugation width of at least about 5 inches and preferably of between about 5½ to 6 inches so as to maximize the strength of the girder when made from flat sheet stock of standard width, say 48 or 52 inches.

The connection member is defined by the above mentioned diagonal webs which are interconnected by upper and lower, curved crown sections which are also provided with corrugations. The securing means preferably includes high strength bolts, rivets or the like and further means which provide for a firm metal-to-metal contact between the chord plates and the respective crown sections so as to establish a friction lock between the chord plates and the connection member. The contact establishing means may be defined by a slight difference in the base width of the nesting corrugations so that the corrugation peaks extend fully into mating corrugation troughs until the peaks contact the troughs. Alternatively, if the corrugations have uniform base widths, means such as raised bosses formed in the chord plates or, preferably in the crown sections, or in both, appropriately shaped washers, or the like are provided and located so that the bolt extends through them and, upon tightening, establishes the friction lock.

The invention further provides particularly advantageous manners of constructing the girder, including its ends by either diagonally or perpendicularly inclining one of the chord plates, say the lower one until it contacts the other chord plate. This helps to reduce manufacturing costs while giving the girder an attractive appearance and the desired structural integrity.

The girder of the present invention thus combines the cost advantages derived from some of the above discussed prior art girder structures for light forms of construction with the high strength characteristics of fabricated prior art girders. This is accomplished by employing the structurally highly efficient, uniform corrugation profile of the present invention with simple, yet efficient and safe forms for the components and connections between them. Thus, a girder constructed in accordance with the present invention represent a significant advance in the art of girder structures, both from a structural and from an economic point of view.

DESCRIPTION OF THE PREFERRED EMBODIMENT

Figure 1:
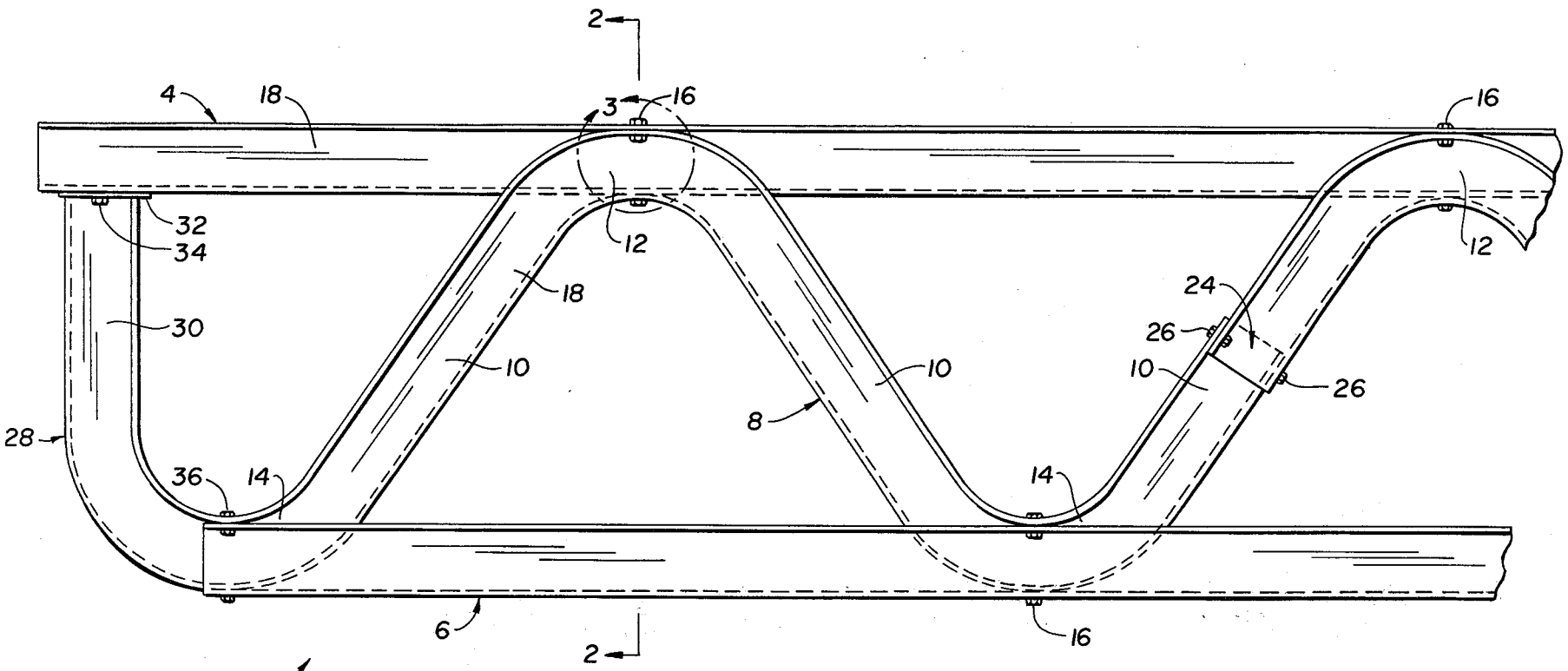
FIG. 1 is a fragmentary, enlarged side elevational view of a lightweight, high strength girder constructed in accordance with the present invention.
Figure 2:
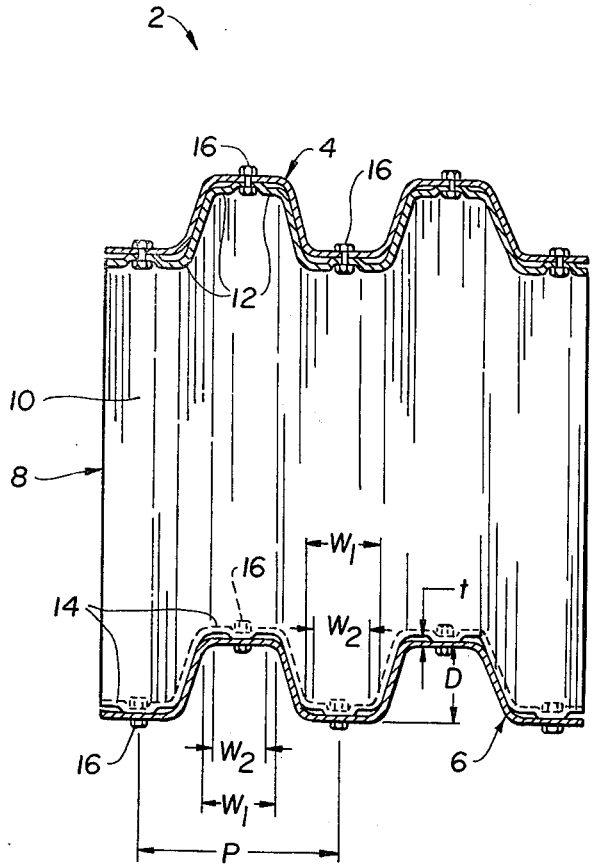
FIG. 2 is an elevational view, in section, and is taken on line 2—2 of FIG. 1.
Figure 3:
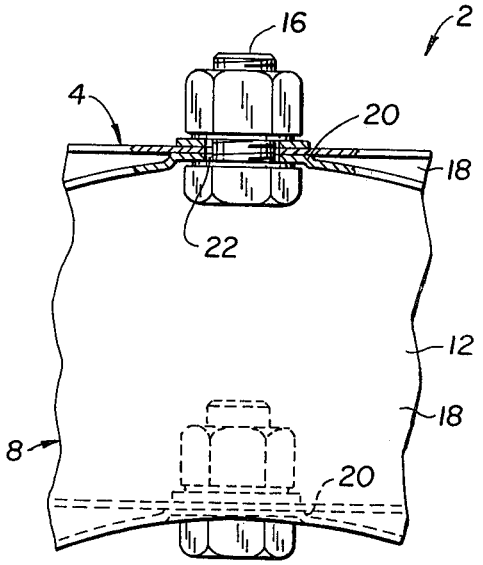
FIG. 3 is an enlarged, side elevational, fragmentary view, in section, of the portion of FIG. 1 indicated by circular line 3.

Referring to FIGS. 1–3, a girder 2 constructed in accordance with the present invention generally comprises an upper chord plate 4, a lower chord plate 6 and an intermediate, sinusoidally undulated connecting member 8 defined by a plurality of serially arranged, diagonally disposed webs 10 which are interconnected by curved upper and lower crown sections 12 and 14, respectively. High strength bolts 16 (or welds, rivets or the like, not shown) secure the crown sections to the respective chord plates and thereby complete the girder which, in use, is suspended between spaced apart supports for carrying a payload.

At least the upper chord plate and preferably both chord plates as well as the connecting member are constructed of corrugated plate having longitudinally running corrugations 18 defined by alternating corrugation peaks and corrugation troughs of substantially the same dimensions and further having a trapezoidal cross-section as is best shown in FIG. 2. In order to attain the desired high strength and rigidity the corrugations have a pitch "P" of at least about 16 inches and a corrugation depth "D" of at least 5 inches and preferably of between 5½ to 6 inches. In this manner, a girder constructed from standard flat sheet stock, such as 48 or 52 inch wide stock, can be provided with at least two full corrugations. As a result, the girder has great lateral strength and rigidity while providing a great strength and rigidity in a direction perpendicular to the chord plates and enabling the corrugation of the plate from flat steel having a yield stress of up to 50,000 psi without overstressing the material while it is corrugated in conventional corrugating equipment such as is disclosed, for example, in U.S. Pat. No. 940,965.

To effect the proper seating between the upper and lower chord plates 4, 6 and the upper and lower crown sections 12, 14 of connecting member 8, it is normally necessary to take into consideration the material thickness "t" of the chord plates and the connecting member. In accordance with one embodiment of the invention, the corrugations are formed so that the base width "W1" and "W2" (see FIG. 2) of the corrugation peaks and valleys alternatingly differ. In the presently preferred embodiment of the invention, the difference between "W1" and "W2" is one plate thickness "t" so that the corrugation peak and valley base widths alternatingly differ by approximately one material thickness. As a practical approximation the base widths may, for example, differ by 3/16", which can accommodate the nesting of corrugations having material thicknesses of ¼" to ¼", ¼" to 14 gauge, or 14 gauge to 14 gauge. The corrugation pitch "P" and depth "D", however, remain unchanged.

Alternatively, and referring momentarily particularly to FIG. 3, one of the corrugated plates 4, 6, and of the connecting member 8, and preferably the latter is provided with raised bosses or dimples 20 which have a generally circular configuration and which are located at the nadir and zenith points of the crown sections. Bolt holes 22 for threaded bolts 16 are concentrically formed in the raised bosses. Each boss is raised from the curved periphery of the corresponding crown section a distance so that the upwardly or downwardly facing mating surface of the boss securely engages the opposing surface of the chord plate when the bolt is tightened to assure a firm friction connection between the two. In a practical embodiment of the invention in which the chord plate and the connecting members are constructed of a material having a thickness of ¼", the boss projects past the curved periphery of the crown sections 5/16".

Under certain circumstances, it may be preferable to substitute appropriately shaped, e.g. curved washers (not shown) for the bosses. The washers are then placed between the chord plate and the crown section and upon tightening of the bolt desired friction connection is established.

In the presently preferred embodiment of the invention connecting member 8 is continuous, that is it is made single length of initially straight corrugated plate which is undulated by placing it in appropriate machinery to form the alternating diagonal webs 10 and the upper and lower crown sections 12, 14. If preferred, due to the available length of corrugated plate, forming machinery and the like connecting member may be assembled from serially arranged generally L-shaped, Z-shaped, or multiple Z-shaped sections In such an event, joints 24 between such sections are preferably placed midway between the chord plates (see FIG. 1) bolts 26 secure the overlapping ends of the section each other in a manner similar to the manner in which crown sections 12, 14 are secured to chord plates 4, 6.

Under certain circumstances and load applications, it may be desirable to provide the connecting member with corrugations which differ from those of the chord plate. For example, the member and size of the corrugations of the connecting member may be different from those of the chord plates. Normally, however, the corrugation sizes and shapes of the chord plates and the connecting members will be the same.

Ends 28 of the girder are defined by end plates 30 which are preferably also constructed of the same corrugated material of which the chord plates and the connecting member is constructed. In the embodiment of the invention illustrated in FIGS. 1–3, the end plate is vertically disposed and integrally constructed with the connecting member 8. A flange 32, attached to the end plate, and bolts 34, 36, rigidly connect the end plate to the upper and lower chord plates.

Figure 5:
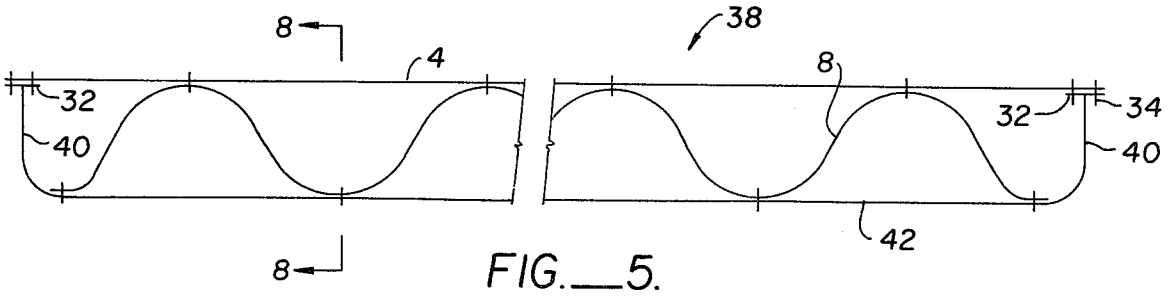
Figure 7:
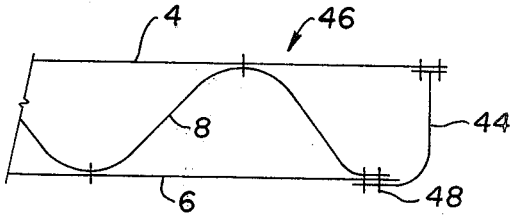

Referring now to FIG. 5, a girder 38 has a somewhat different construction from that of the girder 2 shown in FIG. 1 insofar as its perpendicular end plate 40 is integrally constructed with its lower chord plate 42 by deforming, e.g. bending the ends of the initially flat lower chord plate 90°. In all other respects the girder shown in FIG. 5, including its top chord plate 4 and its connecting member 8 are constructed in the same manner in which girder 2 shown in FIG. 1 is constructed. In an alternative construction, shown in FIG. 7, the perpendicular end plate 44 of the girder 46 has a generally L-shaped configuration, is independently constructed of both the lower chord plate 6 and the sinusoidally shaped connecting member 8, and is secured to the ends thereof with a set of bolts 48 or the like. The connection of the L-shaped end plate 44 to the upper chord plate 4 is the same as previously discussed.

Figure 8:
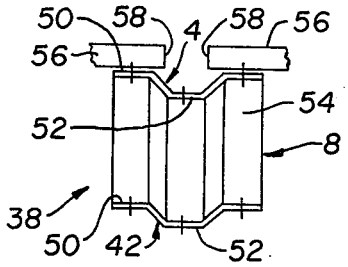
FIG. 8 is a schematic, side elevational view and is taken on line 8—8 of FIG. 5.
Figure 9:
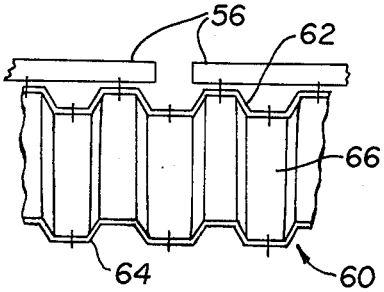
FIGS. 9 and 10 are schematic, side elevational views, in section, similar to FIG. 8 but show alternative embodiments of the invention.
Figure 10:
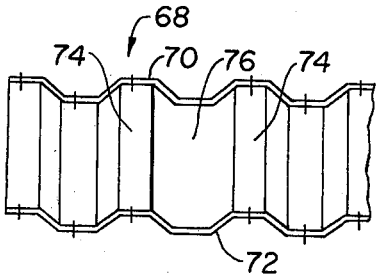

FIGS. 8–10 illustrate a variety of preferred girder cross-sections. FIG. 8 illustrates the cross-section of girder 38 which is defined by one full corrugation including a corrugation peak 50 and a corrugation trough 52 plus one flat end flange 54 (or additional corrugation peak) Both chord plates 4, 42 and the chord plate connecting member 8 have the same profile or cross-section. This structure is advantageous for relatively lesser load applications, such as for supporting ends of roof panels 56 which may be corrugated in a direction perpendicular to the corrugations of girder 38 with panel ends 58 terminating at corrugation trough 52 so that the trough can be employed as a water collection and drainage channel.

FIG. 9 shows an alternative embodiment of the invention in which a girder 60 is defined by relatively wider upper and lower chord plates 62, 64 which are interconnected by a correspondingly wider, sinusoidally undulated connecting member 66. This girder is particularly adapted for supporting roofs of a greater width, for example, and/or subjected to greater payloads. Roof panels 56 are carried by the girder in the previously described manner.

FIG. 10 illustrates a girder 68 which is similar to the one shown in FIG. 9, which has upper and lower chord plates 70, 72 each of which defines a plurality of side-by-side parallel corrugations but which has a pair of relatively narrower sinusoidally undulated connecting members 74 which secure the chord plates to each other and which define between themselves, an open space 76. In all other respects, the girder is constructed in the same manner as was previously described.

Figure 4:
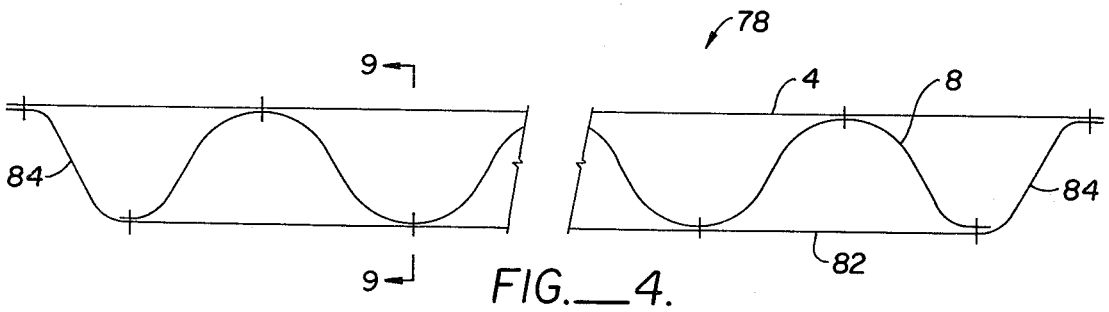
FIGS. 4–7 are schematic, side elevational views of girders constructed in accordance with various embodiments of the inventions.
Figure 6:
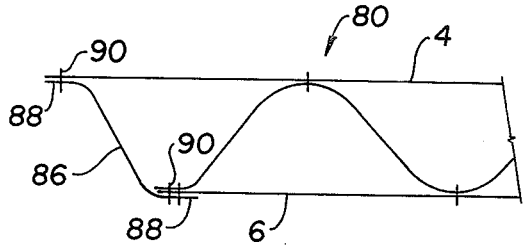

Referring now to FIGS. 4 and 6, in an alternative embodiment of the invention, a girder 78 (FIG. 4) or 80 (FIG. 6) is constructed as above-described. Thus, each of them includes an upper chord plate 4 and the earlier described sinusoidally undulated connecting member 8. Girder 78 (FIG. 4) includes a lower chord plate 82, the ends of which are diagonally inclined to define diagonally disposed end plates 84 which interconnect the upper and the lower chord plates. Girder 80 (FIG. 6) includes substantially the same lower chord plate 6 as does girder 2 in FIG. 1, but further includes a generally Z-shaped end plate 86 which is diagonally inclined with respect to the chord plates and which has end flanges 88 that are secured to the chord plates with bolts 90.

Figure 11:
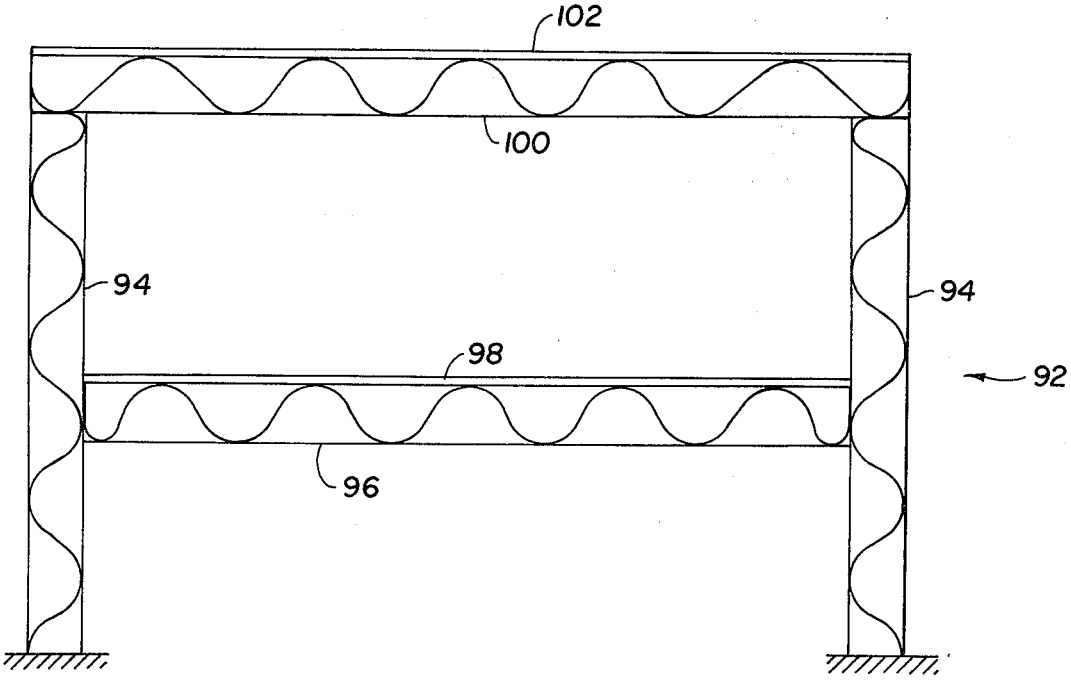
FIG. 11 is a schematic, side elevational view of a building structure employing the girders of the present invention as upright and horizontal load carrying members.

Referring now to FIG. 11 the use of the previously described girders in a typical building 92 is illustrated. A first set of vertically disposed girder posts or columns 94 includes opposing chord plates 4, 6 which are interconnected by a sinusoidally undulated connecting member 8 in the earlier described manner. A wall or sheeting may be applied to the outer chord plate, or the girder may be integrated with the wall to enclose the building interior. An intermediate, horizontally positioned girder 96 may be suitably secured to the girder post 94 with brackets and the like (not shown) for supporting an intermediate building floor 98 while horizontally disposed roof girders 100 may be directly supported on the upper ends of the posts for carrying the building roof 102. It will be noted that this construction of the building and, in particular, its horizontal members gives it great strength while substantially reducing its overall costs.

I claim:

1. A high strength, relatively lightweight girder comprising a substantially rigid upper chord plate and a substantially rigid, spaced apart, parallel lower chord plate, the chord plates being constructed of corrugated plate, the corrugations of one chord plate being in substantial alignment with the corrugations of the other chord plate, the corrugations further having a generally trapezoidal cross-section, a corrugation pitch of at least about 16 inches and a corrugation depth of at leat about 5 inches; a substantially rigid connecting member disposed between the chord plates and defining a plurality of serially arranged diagonal webs and curved crown sections interconnecting the webs, the connecting member further defining corrugations extending over the substantially full length of the connecting member in the direction of and in substantial alignment with the corrugations in the chord plates so that the corrugations of the connecting member nest in corresponding corrugations of the chord plates; an end plate at each end of the girder interconnecting proximate ends of the chord plates; bosses formed in at least one of the chord plate and the connecting member establishing metal-to-metal contact between the chord plates and the crown sections; and means securing the crown sections in the area of the bosses to the chord plates and for connecting the end plates to corresponding ends of the chord plates.

2. A high strength, relatively lightweight girder comprising: spaced apart, parallel upper and lower chord plates at least one of which being constructed of corrugated plate defining alternating, trapezoidally shaped corrugation peaks and troughs of substantially like dimensions and extending in a longitudinal direction of the plates; a sinusoidally shaped chord plate connecting member disposed between the plates and having a sufficient width so as to define at least one corrugation peak and corrugation through which extend in the direction of the peaks and troughs of the at least one chord plate and which are sized and shaped complimentarily thereto, the member having a plurality of serially arranged, diagonally disposed webs interconnected by upper and lower crown sections; the corrugation peaks and troughs of the crown sections being nested within corresponding corrugation peaks and troughs of the at least one chord plate; a boss defined at the corrugation peaks and corrugation troughs in at least one of the nesting portions of the crown sections and the respective chord plates so as to establish metal-to-metal contact areas between such corrugation peaks and corrugation troughs, the areas being substantially flat, parallel to and abutting against the opposing corrugation peak or trough; and means disposed at the bosses and overlying at least a portion of the areas for rigidly securing the crown sections and, therewith the connecting member to the respective chord plates.

3. A lightweight, high strength girder comprising: an upper chord plate constructed of corrugated plate having longitudinally extending alternating, parallel and substantially flat corrugation peaks and corrugation troughs of substantially like shape and dimensions interconnected by slanted corrugation sides; a spaced apart lower chord plate which is substantially parallel to the upper chord plate; a sinusoidally undulated connection member disposed between the chord plates and defining a plurality of serially arranged, generally longitudinally directed diagonal webs disposed between the chord plates, the member including at least one longitudinally extending corrugation shaped complimentarily to the corrugations of the upper chord plate and including at least one corrugation peak and at least one parallel corrugation trough nested in corresponding corrugation peaks and troughs of the upper chord plate; fastening means for rigidly securing the connection member to the lower chord plate at points at which they are in mutual engagement; attaching means for rigidly securing to each other the nesting corrugation peaks and corrugation troughs of the upper chord plate and the connection member; and a generally circular boss in one of the upper chord plates and the connection member establishing abutting, substantially flat metal-to-metal contact areas at said attaching means between the substantially flat corrugation peaks and troughs of the upper chord plate and the corrugation peaks and corrugation troughs of the connection member nesting therein, the contact areas being arranged so that they at least in part underlie and directly support the attaching means.

4. A girder according to claim 3 wherein the boss is formed in the connection member, and wherein the fastening means comprises bolt means extending through aligned apertures in the boss and in the upper chord plate.

* * * * *